United States Patent [19]

Hengelhaupt

[11] 3,977,511

[45] Aug. 31, 1976

[54] RIBBON LOADING DEVICE

[75] Inventor: Hans Hengelhaupt, Nurnberg, Germany

[73] Assignee: Triumph Werke Nurnberg A.G., Nurnberg, Germany

[22] Filed: Apr. 2, 1975

[21] Appl. No.: 564,495

[52] U.S. Cl. ..... 197/151; 197/170

[51] Int. Cl.[2] ..... B41J 31/10

[58] Field of Search ..... 197/151, 168, 170

[56] References Cited

UNITED STATES PATENTS

| | | | |
|---|---|---|---|
| 735,271 | 8/1903 | Kempf | 197/170 |
| 922,927 | 5/1909 | Magnus | 197/151 |
| 1,410,594 | 3/1922 | Peterson | 197/151 |
| 2,873,015 | 2/1959 | Gray | 197/170 |
| 3,062,351 | 11/1962 | Canny | 197/170 |
| 3,151,724 | 10/1964 | Ross et al. | 197/151 |
| 3,396,828 | 8/1968 | Moshier et al. | 197/151 |
| 3,799,315 | 3/1974 | Stewart | 197/151 |

*Primary Examiner*—Edgar S. Burr
*Assistant Examiner*—William Pieprz
*Attorney, Agent, or Firm*—Joseph R. Spalla

[57] ABSTRACT

A device for installing an inking ribbon in the ribbon fork of a typing machine comprising a housing having spool locating means for receiving and locating a ribbon pay-off and take-up spool, a guide in the housing for cooperating with locating means on the typing machine for locating the said spools in their correct positions on the typing machine when the device is installed in position thereon, the housing having guide surfaces for folding the ribbon on its path from the pay-off spool to the take-up spool so that a portion of the ribbon is folded in such a manner that it can be introduced into guide hooks on the ribbon fork on the typing machine when the device is in position therein without the need for the installer to manually feed the ribbon through the ribbon fork.

17 Claims, 5 Drawing Figures

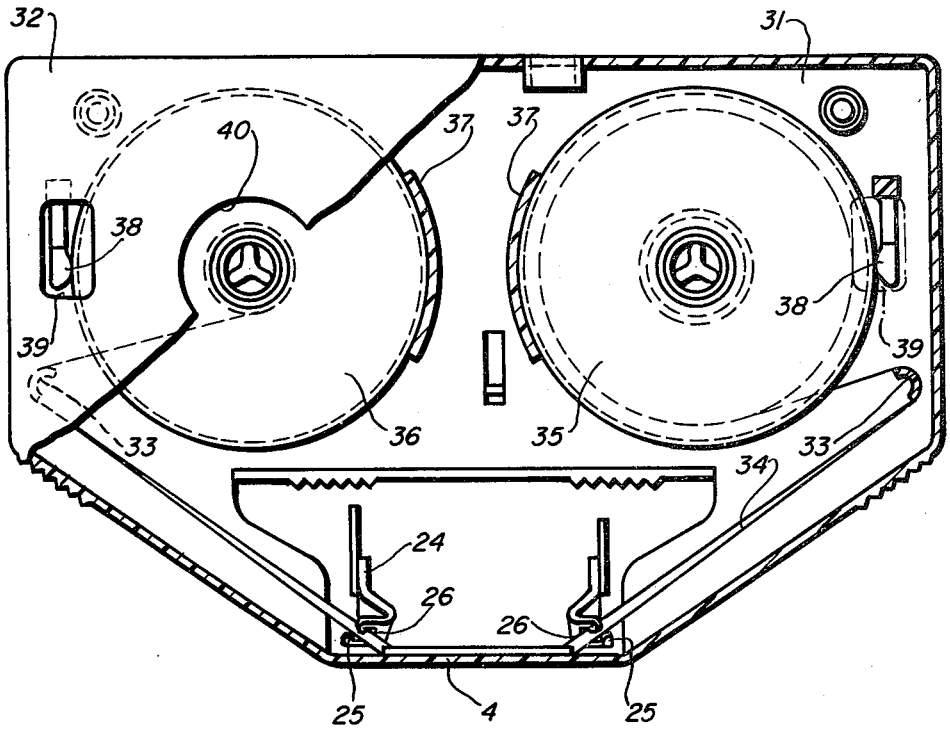
Fig_4
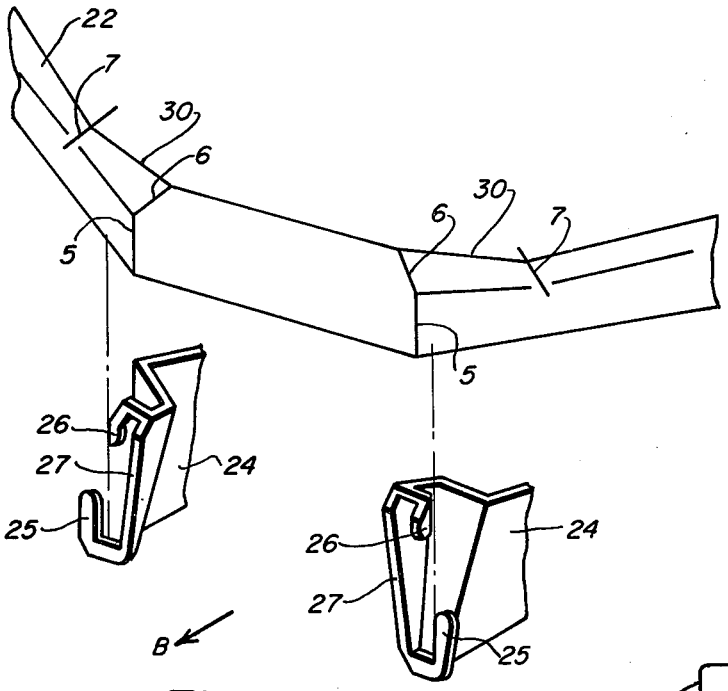
Fig_3
Fig_5
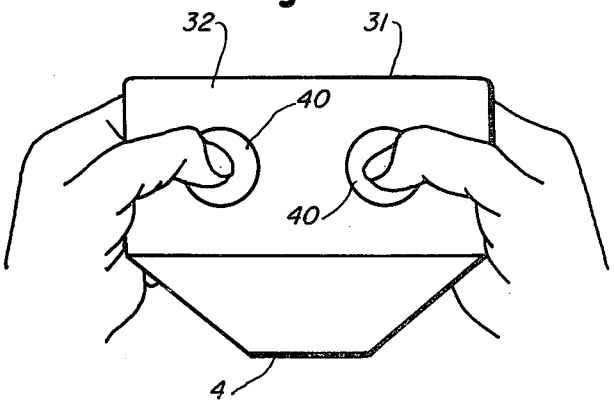

RIBBON LOADING DEVICE

This invention relates to a device for installing an inking ribbon in the ribbon fork of a typing machine such as a typewriter without the need for the installer to manually feed the ribbon through the ribbon fork.

The changing of the ribbon in a typing machine such as a typewriter, because of the dirty nature of the job, is one of the most unpopular operations which the typist or operator has to carry out. Consequently, a number of devices have become known, which are intended to facilitate the introduction of inking ribbons into guides provided in the machine, and in particular into the ribbon fork. However, handling these devices requires a certain degree of skill which is not always easy to acquire. For example, a cassette has been proposed in which the ribbon is guided over two projecting parts which are intended to facilitate the introduction of the ribbon into the ribbon fork. However, because of the restricted space available in known typewriters this is not always very easy particularly as the cassette device has to be pulled apart with quite a substantial degree of force in order to separate the two cassette halves before they can be placed on the spindles of the ribbon mechanism.

Other cassettes have been proposed in which an inking ribbon is so arranged in the cassette, around guide pins, that its position corresponds to that which it will ultimately occupy in the typewriter. Consequently, the complicated business of threading the ribbon around specific guides on the typewriter, is avoided. The cassette consists of a container section and a cassette base which at a given moment can be removed. After the insertion of the ribbon, the container section can also be removed from the machine. This device, although possessing certain advantages, has the decisive drawback that the ribbon must be manually introduced into the ribbon fork by the operator using her fingers or some other aid. Quite apart from the fact that the ribbon is frequently incorrectly introduced into the fork, there is a considerable risk of the typist's or operator's fingers becoming dirty.

It is an object of the present invention, therefore, to provide a device whereby the ribbon can be correctly located on the guides provided for this purpose in the machine, as well as being automatically fed into the ribbon fork without the need for the installer to manually feed the ribbon through said fork.

According to the invention there is provided a device for installing an inking ribbon in the ribbon fork of a typing machine comprising a housing having spool locating means for receiving and locating a ribbon pay-off and take-up spool, a guide in the housing for cooperating with locating means on the typing machine for locating the said spools in their correct positions on the typing machine when the device is installed in position thereon, the housing having guide surfaces for folding the ribbon on its path from the pay-off spool to the take-up spool so that a portion of the ribbon is folded in such a manner that it can be introduced into guide hooks on the ribbon fork on the typing machine when the device is in position thereon without the need for the installer to manually feed the ribbon through the ribbon fork.

The device of the invention has the advantage that the operator or typist simply places the device on the machine, releases the ribbon spools and then removes the device leaving the spools correctly positioned on the typing machine. Without any need to touch the ribbon at all, the latter is thus introduced into its guides and also into the generally complicated ribbon fork. As described hereinafter, it is immaterial in this context whether it is an ordinary fabric ribbon or a carbon ribbon consisting of a synthetic material foil, which is involved.

Preferably, the device includes suitable holding elements, by means of which the ribbon spools are prevented from falling out of the device when introduced into the machine. The holding elements can easily be released so that the ribbon spools remain behind in the machine when the device is removed.

Two preferred embodiments of the invention will now be described, by way of example only, with reference to the accompanying diagrammatic drawing, in which:

FIG. 3 is a partial perspective view showing a ribbon fork with an inking ribbon mounted in a loading device located above it ready for insertion therein to the inserted position shown in FIG. 2;

FIG. 4 is a plan view similar to FIG. 2 showing a loading device similar to that of FIG. 1 containing carbon ribbon spools; and FIG. 5 is a plan view schematically illustrating the manner of removing the ribbon spools from a device in accordance with the embodiment of FIG. 4.

Figure 1:
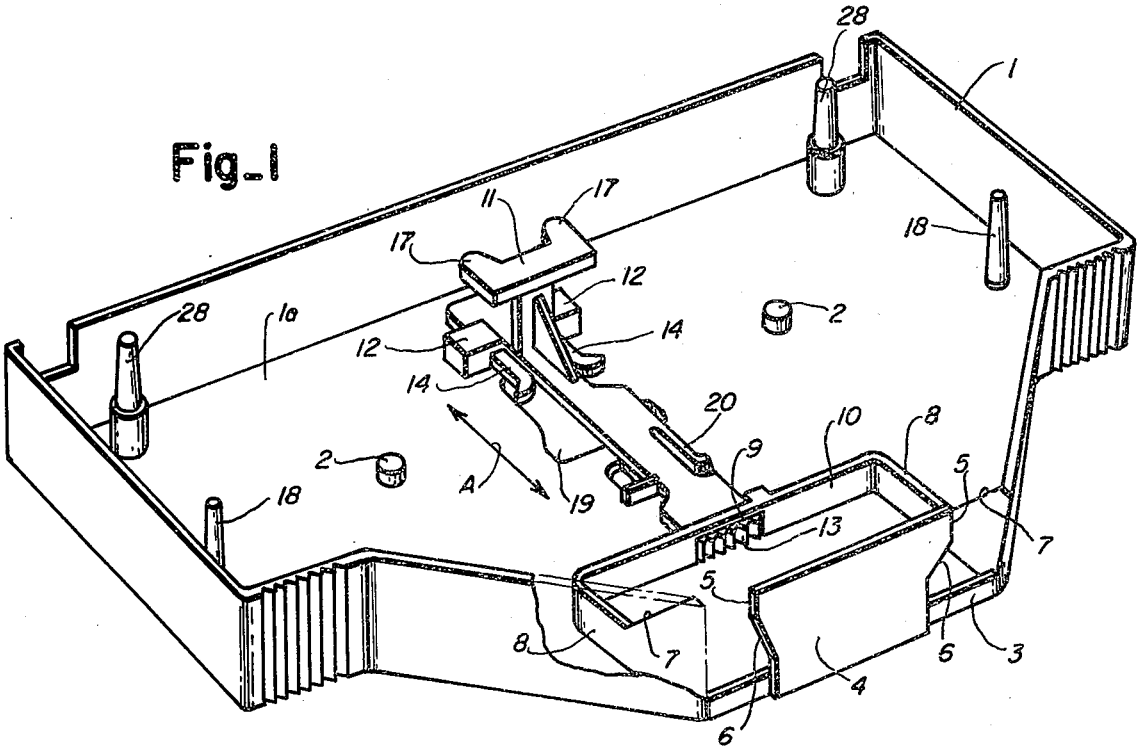
FIG. 1 is a perspective view of a loading device of the invention in an inverted position for reception of wound fabric ribbon spools.
Figure 2:
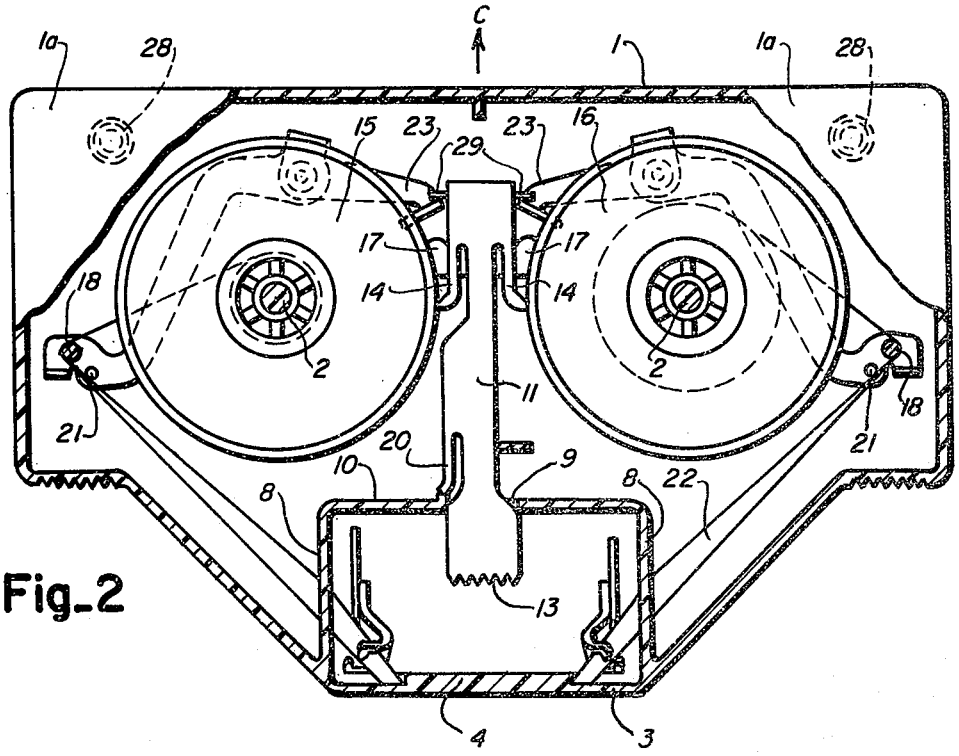
FIG. 2 is a plan view with portions of the loading device of FIG. 1 cut away containing fabric ribbon spool after insertion into a structure supported on a typing machine.

Referring now to the drawing, there is shown in FIGS. 1–3, a device for containing a fabric ribbon. This device comprises a container 1 with spool locating lugs 2 on the floor thereof. An inking ribbon guideplate 4 is provided at one end face 3, the guideplate having vertical guide edges 5 which lead into inclined guide edges 6. Opposite these edges 5, 6 and set back slightly, there are other inclined guide edges 7 formed on side walls 8 of the container 1. Through an opening 9 in a transverse wall 10, a plunger 11 passes, this being prevented from dropping out of the body of container 1 by the provision of additional guide lugs 12 on the bottom wall 1*a* adjacent the end of the plunger farthest from wall 10. This plunger 11 is movable in the direction of the double arrow A. The plunger 11 has a grip 13 at one end and locking means in the form of two spring lugs 14 at its opposite end. As FIG. 2 shows, in this specific position of the plunger 11, these lugs 14 abut against the edges of a take-up spool 15 and a pay-off or supply spool 16. Thus, the spools are prevented from rotation in an uncontrolled way, and the ribbon is maintained taut. In order to prevent the spools 15 and 16 from dropping out of the container 1, the plunger 11 also has spool retaining means in the form of two lugs 17 which, when the plunger 11 is in its locking position shown in FIG. 2, extend beyond the spool flanges and thereby retain the spools within the container 1. It will be appreciated that the container must be adapted to fit on the ribbon guides provided in the typewriter to which it is to be fitted so guide pins 18 are provided, which will not be described in more detail here because they are dependent upon the ribbon guide system in said typewriter, and, accordingly, may vary from typewriter to typewriter. An opening 19 is provided in the bottom of the container 1 beneath the plunger 11 to insure that the spool flange is reliably engaged by the spring lugs 14. The plunger 11 also carries an additional spring lug 20 on one side which acts as a stop against the transverse wall 10 to determine the locked position of the plunger 11 shown in FIG. 2. The lug 20 is of spring design in order to enable the plunger 11 to be passed through the opening 9 in the transverse wall 10, by depressing the lug.

In FIG. 2, the loading device, after ribbon spools have been mounted therein in the FIG. 1 position, is shown inverted with parts of bottom wall 1*a* cut away following loading on machine structure. The inking ribbon 22 is fed from the supply spool 16, around one of the guide pins 18, over the inclined edge 7, over the outside face of the guideplate 4 and then over the other opposite edge 7, around a further guide pin 18 and ultimately to the take-up spool 15. In the example illustrated, ribbon guide pins 21 supported on ribbon mechanism of the typewriter are shown, these being arranged on conventional change-over levers 23 also supported on ribbon mechanism of the typewriter to which the device is to be fitted.

FIG. 3 shows a ribbon guide head 24 of a ribbon fork of a typewriter or similar machine. This head is provided with a pair of ribbon guides each of which comprises two spaced hook-like lugs 25 and 26, which locate behind ribbon 22. If the ribbon is inserted properly, then it is guided over the front face of edges 27 of the guide head 24 in the direction of the arrow B. Above this guide head 24, FIG. 3 also shows how the ribbon 22, extending between ribbon spools mounted in the loading device when in the FIG. 1 position and which is thereafter inverted for loading, is guided by the edges 5, 6 and 7 on the guideplate 4 in order to insure that it can be automatically introduced into the guide head 24.

The function of the device described is as follows: the ribbon spools 15 and 16 are placed on the spool locating lugs 2 of the device 1, in the factory, the inking ribbon being guided around the pins 18 and the edges 7, 5 and 6 of the device. When the plunger 11 is in the locking position shown in FIG. 2, the spring lugs 14 prevent any unwanted rotation of the spools, and the lugs 17 prevent the spools from dropping out of the device. The device 1 can be provided at the side opposite to the baseplate 1*a*, with a cover so that it can be used simultaneously as a shipping and sales package. The device, inverted from the FIG. 1 position, is adapted to be placed on the ribbon mechanism of a typewriter, pins 28 locating the device in its required position. In so doing, the open cores of the spools 15 and 16 slide onto the spool spindles of the ribbon mechanism of the typewriter which have not been shown. The guide pins 18 insure that the ribbon is located in its correct position with respect to the guide pins 21 on the typewriter. When the plunger 11 is operated in the direction of the arrow C (see FIG. 2), the spring lugs 14 leave the flanges of the spools 15 and 16 and the lugs 17 release the spools. If required, the plunger 11 may also carry additional lugs or actuator faces 29 which cooperate with the ribbon change-over levers 23 of the typewriter ribbon mechanism so that these levers are released and, for example, urged by a spring into a likewise predetermined position.

In accordance with the chain-dotted lines shown in FIG. 3, the ribbon slides over the slightly set back hooks 26 of the guide head 24 so that the bottom edge of the ribbon 22 moves behind the hooks 25. The edges 7 of the device 1 slightly bend the top edge of the ribbon, in particular if a pressure is exerted on the device from the top. In so doing, edge portions 30 of the ribbon in each case slide under the hooks 26 of the guide head 24. Then, after the plunger 11 has been operated, the device is lifted away leaving the spools in position on the typewriter, the ribbon tautens because of its own elasticity so that the edge portions 30 move to rotate behind the hooks 26 of the guide head 24 of the ribbon fork. The inking ribbon is thus located in the corresponding guides on the typewriter such as pins 21 and also in the guide head 24 of the ribbon fork, without there having been any need for the installer to touch it with her fingers.

Referring now to FIGS. 4 and 5, there is shown a device 31 similar to that of FIG. 1 into which spools of carbon ribbon 34 have been mounted. The device of FIG. 4 has the same guides as those already described in FIG. 1 relating to the fabric ribbon so no further discussion of these will be made here. In the carbon ribbon device, the baseplate 32 has upstanding guides 33 similar to guides 18, around which the carbon ribbon is guided from supply spool 35 to take-up spool 36. The two spools 35 and 36 bear against abutments 37 under the action of spring lugs 38 which are integrally formed on the device 31 and extend through an opening 39 so that they reliably bear against the spool flanges. In this fashion, the carbon ribbon spools are again prevented from unnecessarily rotating, and also the carbon ribbon spools themselves are prevented from dropping out of the device 31, due to the friction developed. In the baseplate 32, large openings 40 are provided which are employed to manually press the spools 35 and 36 out of the device, as illustrated in FIG. 5, after loading on the machine, in the same manner as the fabric ribbon device. In so doing, the carbon ribbon slides over the corresponding guides 24 of the ribbon mechanism of the typewriter, and automatically enters the ribbon fork without any further action being required. When the device is removed to leave the spools in position on the typewriter, as FIG. 5 shows, it is lifted upwards with the fingers, the thumbs of the two hands of the installer pressing through the two openings 40 onto the spools 35 and 36 so that these latter are forced out, against the action of the spring lugs 38, from the abutments 37 and remain in the ribbon mechanism of the typewriter. This device, too, can be provided with a suitable cover so that a carbon ribbon as well as fabric ribbons can be sent to the customer in a closed shipping container.

As the drawing shows and as the description explains, it is possible, by an appropriate arrangement of guide edges 6, 7 for the inking ribbon, to introduce the ribbon automatically into the ribbon fork of a typewriter. Because the guidance of the ribbon is dependent upon the nature of the ribbon fork of the typewriter to which it is to be fitted, it may be necessary where different ribbon fork designs are concerned, to employ different arrangements of guide edges in the device. It is important, however, that the ribbon should be deflected or folded by the device to such an extent that when the device is removed, the top edge of the ribbon can slide under the top guide hook 26 of the ribbon fork. The other ribbon guides 24 inside the device can, of course, be suitably designed and arranged to accord with each particular typewriter. If the devices 1 or 33 are made of synthetic plastics material, then an inexpensive and simple aid is provided which considerably simplifies the task of changing ribbons in a typewriter.

While the device of the invention has been described with reference to the fitting of an inking ribbon to a typewriter, it will be appreciated that it could equally well be designed to enable an inking ribbon to be fitted to any other business machine such as, for instance, a telex machine which raises and lowers the ribbon during the printing of each character to enable the typist to see what has just been typed.

What is claimed is:

1. A throwaway device for aiding the installation of inked ribbon spools in a typing machine and the simultaneous threading of an inking ribbon extending between spools in the ribbon fork of said typing machine comprising, a housing having spool locating means for receiving and locating a ribbon supply and take-up spool, guides in the housing for cooperating with locating means on the typing machine for locating and mounting the said spools in their correct positions on the typing machine when the device is placed in ribbon loading position thereon, and guide surfaces on said housing for inclining to the plane of ribbon passage through said ribbon fork portions of the ribbon extending between said supply and take-up spools to permit insertion thereof into guide hooks on said ribbon fork when the device is placed in position in said typing machine without the need for the installer to manually feed the ribbon through the ribbon fork, and means for releasably holding said supply and take-up spools in said housing whereby after said spools are mounted and the ribbon extending therebetween is simultaneously threaded, said device may be lifted away.

2. A device as recited in claim 1, said housing including a guide plate having surfaces thereon over which the inclination of said portions of the ribbon is established.

3. A device as recited in claim 2, said surfaces being provided on opposed side edges of said guide plate, said side edges being spaced apart so as to be generally opposite said ribbon fork when the device is in position on the typing machine.

4. A device as recited in claim 3, each of said side edges including a vertical portion and an inclined portion by means of which the inclination of the ribbon is established.

5. A device as recited in claim 2, said housing including additional surfaces over which said portions of the ribbon are inclined prior to it reaching the guide plate.

6. A device as recited in claim 2, said housing being provided with an opening for receiving said ribbon fork when the device is located in position on the typing machine.

7. A device as recited in claim 6, said opening being bounded by wall of the housing.

8. A device as recited in claim 7, said guide plate being one of said walls defining said opening.

9. A device as recited in claim 8, said walls of said opening to either side of said guide plate having upper edges which are inclined to deflect the ribbon before it reaches said guide plate.

10. A device as recited in claim 1, said means for releasably holding said spools in said housing including a plunger movably supported therein and movable from spool locking to spool release position, said plunger having locking means thereon for engaging the supply and take-up spools to prevent inadvertent rotation thereof.

11. A device as recited in claim 10, said locking means comprising a pair of spring lugs, each of which is engageable with a respective supply or take-up spool.

12. A device as recited in claim 10, said plunger being provided with retaining means to hold said spools in said housing.

13. A device as recited in claim 12, said plunger being provided with actuator faces for cooperation with a ribbon change-over lever on the typing machine.

14. A device as recited in claim 13, said locking means, retaining means and actuator faces being arranged so that when the device is fitted with an inking ribbon and positioned on the typing machine, after movement of the plunger to release position, said spools are released to remain in position on the typing machine when said housing is lifted away.

15. A device as recited in claim 10, said locking means comprising, for each spool, an abutment against which the spool is forced under the action of a spring lug.

16. A device as recited in claim 15, said housing including an opening opposite each spool core through which an installer can press to lift away the housing from the spools.

17. A device as recited in claim 15, said spring lugs being formed integrally with said housing.

* * * * *